US006296040B1

(12) United States Patent
Schaap

(10) Patent No.: US 6,296,040 B1
(45) Date of Patent: Oct. 2, 2001

(54) ROLLER SCREEN

(75) Inventor: Henk Schaap, Hilversum (NL)

(73) Assignee: Hamstra-Weesp B.V. (NL)

( * ) Notice: Subject to any disclaimer, the term of this patent is extended or adjusted under 35 U.S.C. 154(b) by 0 days.

(21) Appl. No.: 09/434,732

(22) Filed: Nov. 5, 1999

(30) Foreign Application Priority Data

Sep. 20, 1999 (NL) ..... 1013096

(51) Int. Cl.[7] ..... A47G 5/02; E06B 9/56; E05C 3/14

(52) U.S. Cl. ..... 160/290.1; 160/23.1; 292/228; 292/203

(58) Field of Search ..... 160/290.1, 23.1; 292/DIG. 36, 228, 203, 219, 54

(56) References Cited

U.S. PATENT DOCUMENTS 4,531,562 * 7/1985 Swanson ..... 160/290.1 X
5,090,468 * 2/1992 Tedeschi ..... 160/290.1
5,242,070 * 9/1993 Bretschneider et al. ..... 160/290.1 X
5,573,050 * 11/1996 Henkenjohann ..... 160/290.1 X
5,720,333 * 2/1998 Turvey ..... 160/290.1

FOREIGN PATENT DOCUMENTS

2745560 * 4/1979 (DE) ..... 160/23.1 X
0 579 335 B1 7/1993 (EP) .

* cited by examiner

*Primary Examiner*—Daniel P. Stodola
*Assistant Examiner*—Hugh B. Thompson
(74) *Attorney, Agent, or Firm*—Westman, Champlin & Kelly, P.A.; S. Koehler

(57) ABSTRACT

A roller screen includes a gauze screen, a roll-up mechanism for the gauze screen, a pull beam connected to the free end of the gauze screen, guides for guiding the pull beam and the side edges of the gauze screen. Furthermore spring hooks are used which cooperate with cams present on the ends of the pull beam. The spring hooks are mounted in the ends of the guides remote from the roll-up mechanism on a base which fits in the end of a guide. The spring hooks extend substantially in a longitudinal direction of the guides. The spring force of the hooks can be adjusted by an adjusting screw mounted in the base. The adjusting screw extends substantially perpendicularly to the hook and is accessible via an opening formed in a side wall of the guide.

6 Claims, 3 Drawing Sheets

ROLLER SCREEN

BACKGROUND OF THE INVENTION

The invention relates to a roller screen including a gauze screen, a roll-up mechanism for said gauze screen, a pull beam connected to the free end of said gauze screen, guides for guiding said pull beam and the side edges of said gauze screen, as well as spring hooks cooperating with cams present on the ends of said pull beam, which are mounted in the ends of said guides remote from said roll-up mechanism by a base which fits in the end of the guide. The hooks extend substantially in the longitudinal direction of said guides, and the spring force of said hooks can be adjusted by an adjusting screw mounted in said base.

A roller screen of this kind is known from European patent 579,335. The roll-up mechanism of such a prior art roller screen generally includes a spring, so that the pulled-out gauze screen is tensioned and the gauze screen will constantly tend to roll up again. Since the pull beam is retained in the pulled-out position as a result of the cooperation between the spring hooks and the cams, the gauze screen will be drawn tightly and free of folds before the door or window opening at all times.

With this prior art roller screen, the adjusting screw extends through the base substantially in the longitudinal direction of the guides, and thus substantially parallel to the respective spring hook, and makes contact with a part of the spring hook that extends at an angle to said longitudinal direction. Access to said adjusting screw can be gained only from the side of the base which is present at said end of the guides. The adjustability of the spring force makes it possible to adjust the retaining force between the cams and the spring hooks.

Although this prior art roller screen has proved to be satisfactory in practice, a number of aspects thereof can be further improved. Thus it is not possible in many cases to simply adjust the spring force by manipulating the adjusting screw once the roller screen is mounted in position, because said side of the base is not accessible at the end of the guide. The spring force, once adjusted before the roller screen is mounted in position, can only be changed when the roller screen is at least partially dismounted.

Another disadvantage of the prior art roller screen is the fact that, due to the selected position of the adjusting screw in the longitudinal direction of the guides and the spring hook, the point of application of the adjusting screw on the spring hook varies upon adjustment of the adjusting screw. As a result of this, there is no linear relationship between the movement of the adjusting screw and the increase or decrease of the spring force.

Finally, in some cases, there is a risk that the shifting of the point of application of the adjusting screw will produce a notch effect in the spring hook, due to the sharp screw thread thereof, which will cause damage to the hook and which, in an extreme case, may result in the unintentional collapse thereof.

SUMMARY OF THE INVENTION

The object of the invention is to provide a roller screen of the kind referred to in the introduction, wherein the above drawbacks are overcome in a simple yet efficient manner.

In order to accomplish that objective, a roller screen includes an adjusting screw that extends substantially perpendicularly to the hook and in that said adjusting screw is accessible via an opening formed in a side wall of the guide.

Since the adjusting screw extends substantially perpendicularly to the hook and the hook extends substantially in the longitudinal direction of the guides, the adjusting screw also extends substantially perpendicularly to said guides, so that the adjusting screw will be readily accessible through the aforesaid opening in a side wall of the guide in question. In this manner it remains possible to manipulate the adjusting screw, after the roller screen has been mounted in position, in order to adjust the spring force, if desired. In addition, it is not necessary to dismount the roller screen (completely or partially) in order to do so.

Another effect that is achieved as a result of the fact that the adjusting screw extends substantially perpendicularly to the hook is that the point of application of the adjusting screw on the hook remains at least substantially constant, as a result of which an essentially linear relationship between the movement of the adjusting screw and the increase or decrease of the spring force is obtained. Furthermore, the end of the adjusting screw is prevented at all times from moving over part of the hook, with the screw thread of the adjusting screw producing a notch effect which may cause damage to the hook and which may eventually lead to the premature collapse thereof.

Preferably, the spring hook pivots about a pivot pin which is journalled in the base, wherein the adjusting screw engages a hook portion which is present on the side of the pivot pin opposite the hook end that cooperates with the cam. In this embodiment the spring hook consists of two parts: a hook end cooperating with the cam on one side of the pivot pin and a hook portion engaged by the adjusting screw on the other side of the pivot pin. In this manner the hook end that cooperates with the cam can be designed to have a large free length, thus reducing the risk of the spring hook being overloaded while springing.

The pivot pin may thereby be accommodated in a recess in the base and be locked in position in the base by a retaining cam which projects into said recess. The mounting of the pivot pin (and the spring hook connected thereto) takes place before the base is mounted in the guide. At that moment, deformation of the base enables the retaining cam to deflect, and the pivot pin can pass the retaining cam and move into the recess. When the base is subsequently placed into the end of the guide, the retaining cam can no longer deflect laterally, since the parts of the guide that engage the base render deformation of the base impossible. Thus, the pivot is locked in the base in an excellent manner.

As an extra protection against unintentional moving out of the base by the spring hook, the hook portion may furthermore include a flanged lip at its end, which lip is capable of engaging behind the base. Said lip prevents the spring hook and its pivot pin from moving out of the base.

Finally it is noted that the hook and the pivot pin may be integrally formed.

BRIEF DESCRIPTION OF THE DRAWING

The invention will be explained in more detail hereafter with reference to the drawing, which schematically shows an embodiment of the roller screen according to the invention.

DETAILED DRAWING OF THE ILLUSTRATIVE EMBODIMENTS

Figure 1:
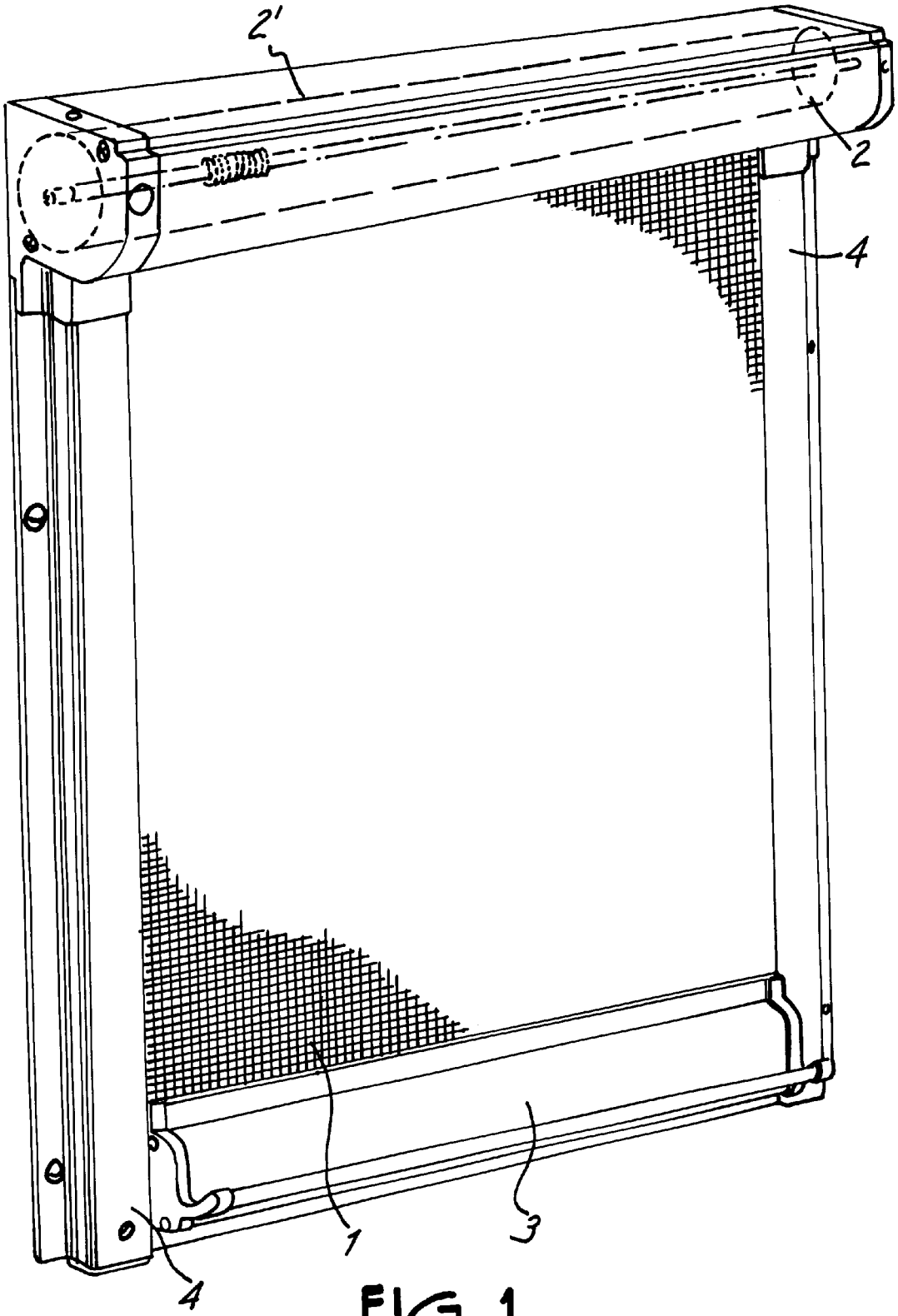
FIG. 1 is a perspective view of an embodiment of the roller screen according to the invention in the pulled-out position of the gauze screen.

FIG. 1 shows a roller screen in the pulled-out position, wherein the gauze screen 1 covers a window opening. The roller gauze screen may also be used with a door, of course. The roller screen comprises a roll-up mechanism 2' for gauze screen 1, which is accommodated in a housing 2. The free end of the gauze screen 1 is connected to a pull beam 3, the ends of which are guided in guides 4, as are the sides edges of gauze screen 1.

Figure 2:
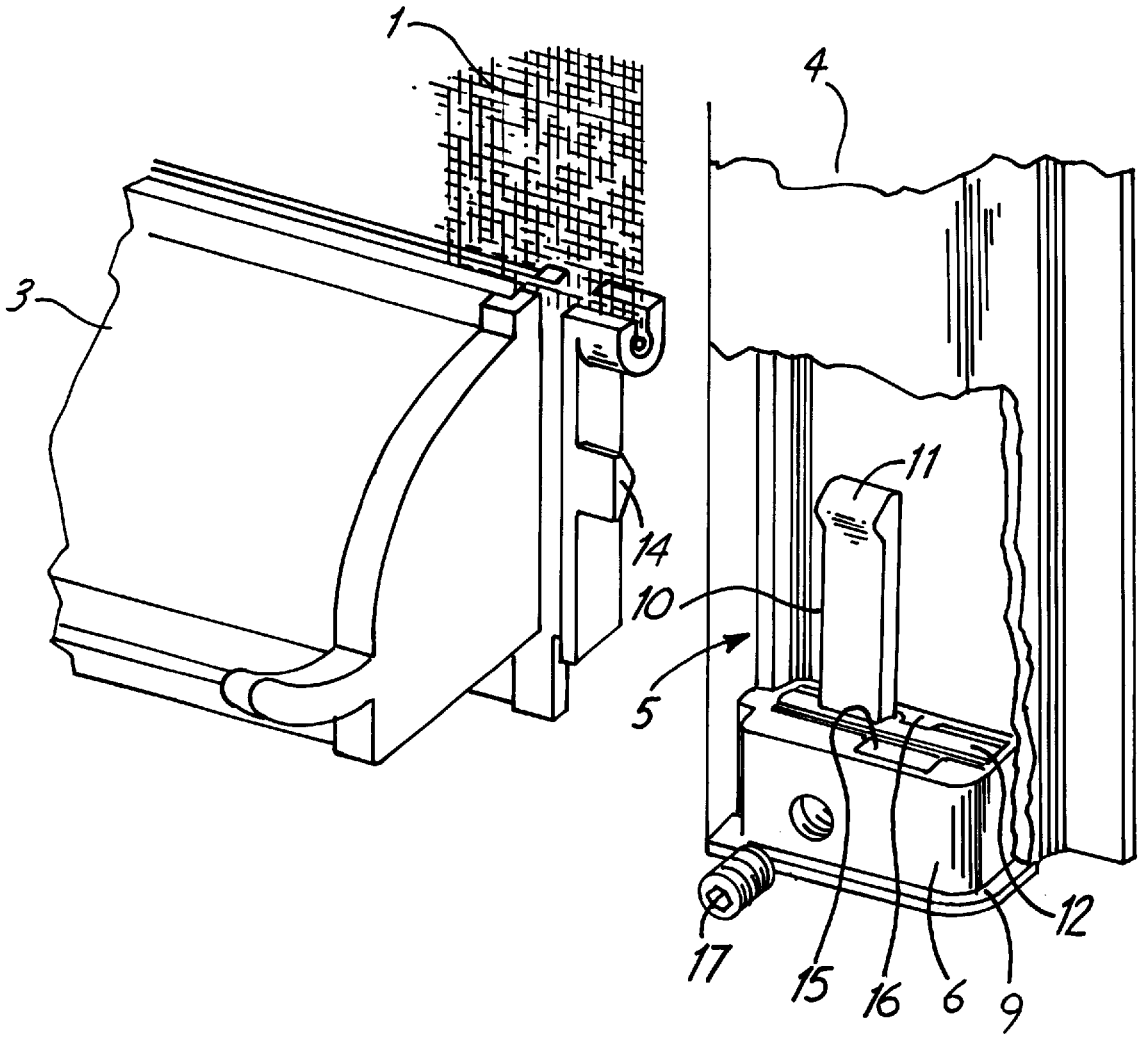
FIG. 2 is a larger-scale, partially cut-away detail of the roller screen of FIG. 1.

As appears from FIG. 2, each guide 4 includes a tubular section including a slot 5, wherein the guides 4 are mounted on either side of the door opening or the like in such a manner that the slots 5 of the guides 4 face each other. A base 6 is mounted in the ends of the guides 4 remote from housing 2. The external shape of said base 6 is adapted to conform to the internal shape of the guide 4. At its rear side (see FIGS. 3 and 4), base 6 includes a wedge-shaped mounting cam 7, which mates with a corresponding opening 8 in guide 4. As a result of this, the mounting of base 6 in guide 4 is a very simple operation. In the mounted position of base 6, a flanged edge 9 abuts the end of guide 4.

A spring hook 10 is mounted in base 6. In the illustrated embodiment, said spring hook 10 includes a hook end 11, a pivot pin 12 integrally connected thereto, and a hook portion 13 present on the opposite side of pivot pin 12. Hook end 11 is intended to cooperate, in a manner known per se, with cams 14 which are mounted on the sides of pull beam 3 (see FIG. 2).

Pivot pin 12 is accommodated in a recess 15 in base 6 and is locked therein by a retaining cam 16 (see FIG. 2). Pivot pin 12 is inserted into recess 15 before base 6 is mounted in guide 4. This enables retaining cam 16 to deflect, due to the deformation of base 6, so as to allow pivot pin 12 to pass. After pivot pin 12 has been inserted into recess 15, the base is placed into the end of guide 4, and the cooperation between the interior of guide 4 and the exterior of base 6 prevents deformation of the latter, and thus movement of retaining cam 16, so that pivot pin 12 is securely locked.

Figure 3:
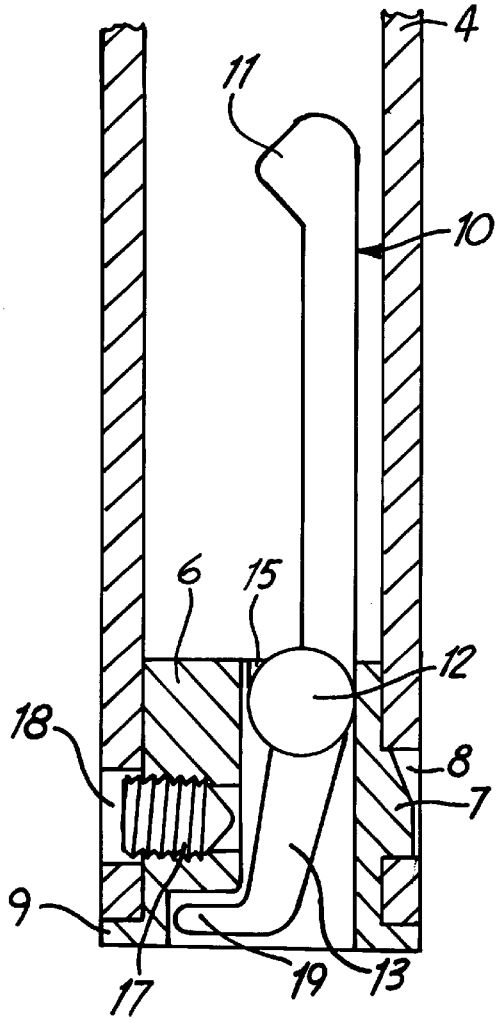
FIGS. 3 and 4 show the spring hooks of the roller screen of FIG. 1 in two different positions thereof.
Figure 4:
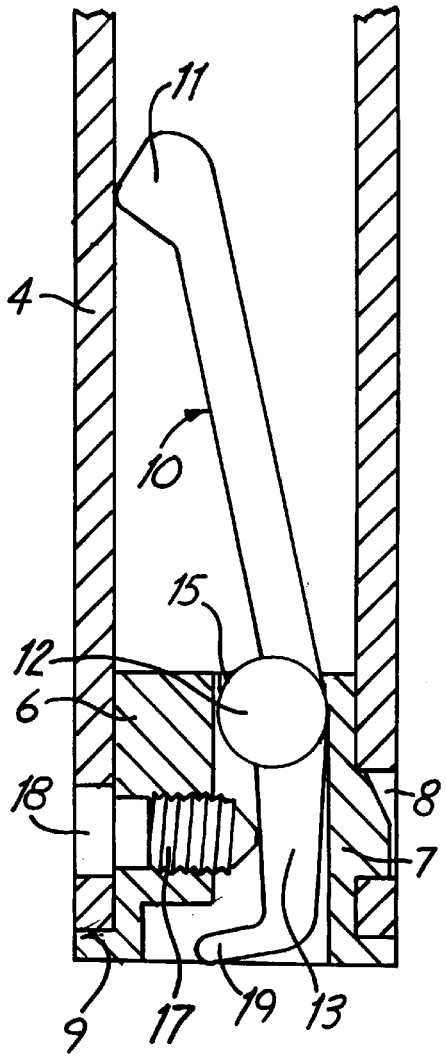

Mounted in base 6 is an adjusting screw 17, which is accessible via a corresponding opening 18 (see FIGS. 3 and 4) in guide 4. Said adjusting screw 17 extends substantially perpendicularly to hook 10. Said adjusting screw 17 is capable of engaging hook portion 13 so as to adjust the spring force with which hook end 11 engages cam 14. In FIG. 3, a minimum spring force is adjusted, whereby adjusting screw 17 is not in contact with hook portion 13 of spring hook 10. In FIG. 4, on the other hand, adjusting screw 17 is shown to be screwed in so as to obtain a maximum spring force. The spring force of hook 10 can be varied as desired by selecting a position of adjusting screw 17 between the positions shown in FIGS. 3 and 4. As a result of this, also the force with which cam 14 is held in position behind hook end 11 is varied.

Since the adjusting screw 17 extends perpendicularly to hook 10, in particular hook portion 13 thereof, a precise adjustment of the spring force is possible. Another effect thereof is that the sharp screw thread cannot make contact with hook portion 13, which makes it possible to avoid damage thereto as a result of the notch effect. Finally, the adjusting screw 17 remains accessible for selectively changing the adjusted spring force, also after the roller screen has been mounted in position.

Finally, hook portion 13 is provided with a flanged lip 19 at its end, which is capable of engaging behind a corresponding part of base 6 for additionally securing hook 10 in base 6. Thus, additional protection is provided against hook 10 unintentionally moving out of base 6 under the influence of a load being applied thereto.

For other details of the above-described roller screen that do not form part of the inventive idea, reference is made to European patent 579,335.

The invention is not restricted to the above-described embodiment, which can be varied in several ways without departing from the scope of the invention as defined in the claims.

What is claimed is:

1. A roller screen comprising a gauze screen, a roll-up mechanism for said gauze screen, a pull beam connected to a free end of said gauze screen, guides for guiding said pull beam and side edges of said gauze screen, and spring hooks cooperating with cams present on ends of said pull beam, wherein the spring hooks are mounted in ends of said guides remote from said roll-up mechanism by respective bases which fit in the ends of the guides, wherein the spring hooks extend substantially in a longitudinal direction of said guides, wherein the spring force of said spring hooks can be adjusted by an adjusting screw mounted in said corresponding base, and wherein the adjusting screw extends substantially perpendicularly to the spring hook and the longitudinal direction of the guides and in that said adjusting screw is accessible via an opening formed in a side wall of the corresponding guide.

2. The roller screen according to claim 1, wherein each spring hook pivots about a pivot pin which is journalled in the base, and wherein the adjusting screw engages a hook portion which is present on the side of the pivot pin opposite a hook end that cooperates with the cam.

3. The roller screen according to claim 2, wherein said pivot pin is located in a recess in the base and is locked in position in said base by a retaining cam which projects into said recess.

4. The roller screen according to claim 3, wherein said hook portion has a flanged lip at its end, which is capable of engaging a portion of said base.

5. The roller screen according to claim 2, wherein said spring hook and said pivot pin are integrally formed.

6. The roller screen according to claim 2, wherein said hook portion has a flanged lip at its end, which is capable of engaging a portion of said base.

* * * * *